US006792331B1

(12) United States Patent
Hamström et al.

(10) Patent No.: US 6,792,331 B1
(45) Date of Patent: Sep. 14, 2004

(54) METHOD AND APPARATUS FOR CONTROLLING THE DRYING PROCESS IN A DRYING SECTION OF A PAPER MACHINE OR THE LIKE

(75) Inventors: Kristian Hamström, Turku (FI); Jorma Kari, Mietoinen (FI); Hans Sundqvist, Turku (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/856,892

(22) PCT Filed: Dec. 3, 1999

(86) PCT No.: PCT/FI99/01003

§ 371 (c)(1),
(2), (4) Date: Aug. 31, 2001

(87) PCT Pub. No.: WO00/34572

PCT Pub. Date: Jun. 15, 2000

(30) Foreign Application Priority Data

Dec. 4, 1998 (FI) ..... 982614

(51) Int. Cl.[7] ..... G06F 19/00
(52) U.S. Cl. ..... 700/208; 700/36; 34/524
(58) Field of Search ..... 700/28, 29, 127, 700/208, 36, 109; 34/88, 414, 463, 524, 445, 446, 451, 540

(56) References Cited

U.S. PATENT DOCUMENTS 4,183,148 A * 1/1980 Koski et al. ..... 34/454
4,590,685 A * 5/1986 Roth ..... 34/268
4,882,855 A * 11/1989 Loser et al. ..... 34/116
4,982,513 A * 1/1991 Loser et al. ..... 34/116
5,377,428 A * 1/1995 Clark ..... 34/446
5,715,158 A 2/1998 Chen
5,718,060 A 2/1998 Mori
5,775,001 A * 7/1998 Kerttula et al. ..... 34/114
5,968,590 A * 10/1999 Ahonen et al. ..... 427/209
6,446,356 B1 * 9/2002 Hamstrom et al. ..... 34/451
6,473,997 B1 * 11/2002 Berg ..... 34/463

FOREIGN PATENT DOCUMENTS

DE 3741 128 A1 6/1988
EP 0 643 165 A2 3/1995
WO WO 98/48107 10/1998

OTHER PUBLICATIONS

International Preliminary Examination Report in PCT/FI99/01003.

* cited by examiner

*Primary Examiner*—Leo Picard
*Assistant Examiner*—Carlos R. Ortiz
(74) *Attorney, Agent, or Firm*—Stiennon & Stiennon

(57) ABSTRACT

A method and apparatus for controlling the drying process taking place in the dryer section of a paper machine or the like. The total drying efficiency required in the dryer section is first calculated by means of a method known as such, and an optimal drying efficiency distribution is compiled. Using the optimal drying efficiency distribution, the dryer section is divided into two or more imaginary drying segments which differ in their drying action, in at least one of which segments there are at least two dryer units using different forms of energy and/or at least two separately adjustable dryer units using the same form of energy. The total drying efficiency obtained is divided, by means of an optimization method known as such, between the said different drying segments in such a way that a good drying efficiency distribution is achieved in terms of the quality of the web being dried.

32 Claims, 2 Drawing Sheets

Figure 1:
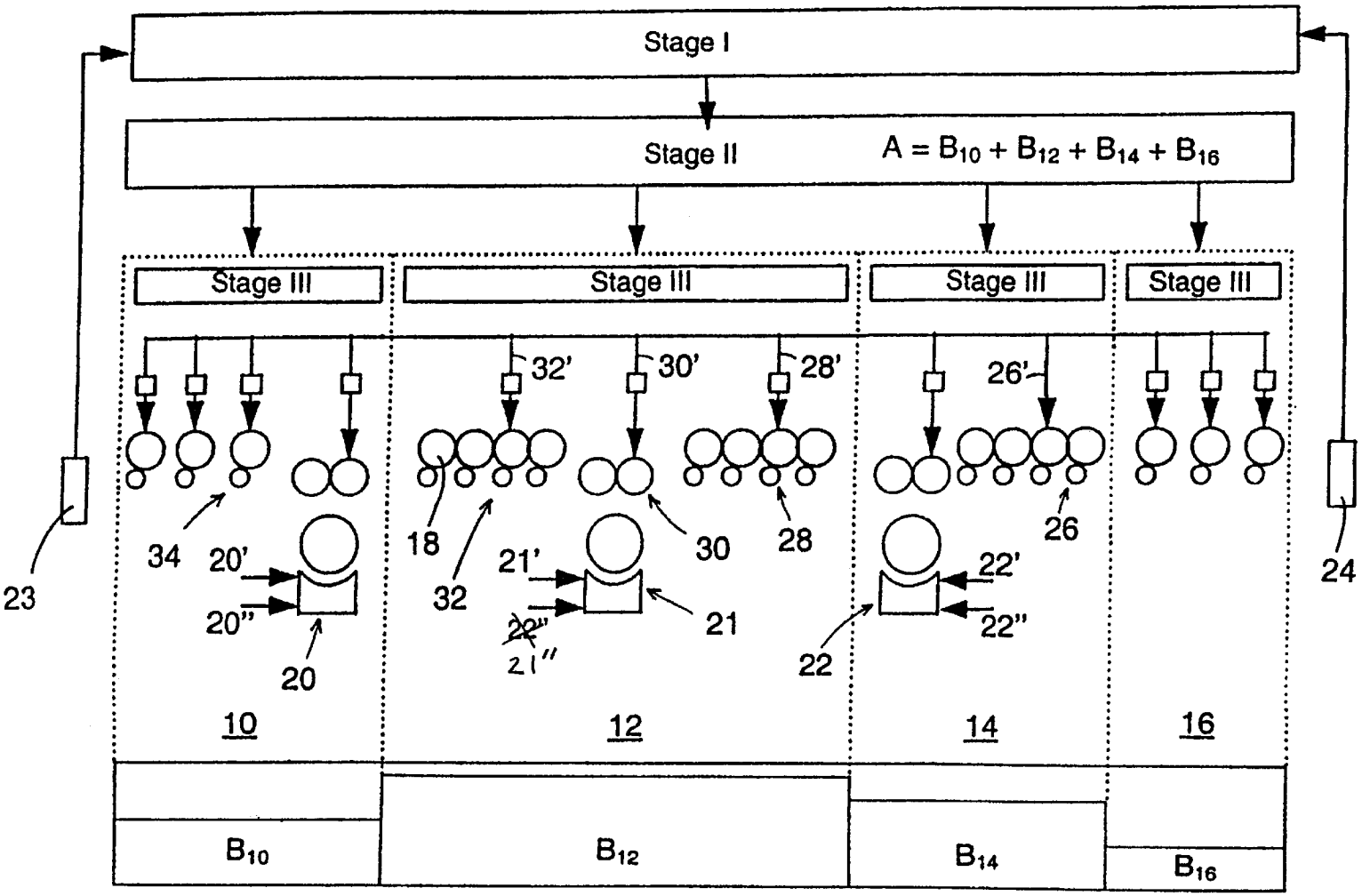

METHOD AND APPARATUS FOR CONTROLLING THE DRYING PROCESS IN A DRYING SECTION OF A PAPER MACHINE OR THE LIKE

The object of the present invention is a method and apparatus relating to the preambles of the independent claims presented below.

The invention relates in this case especially to a method and apparatus for controlling the drying process taking place in the dryer section of a paper machine in such a way that an advantageous drying process is obtained from the viewpoint of quality and/or energy costs.

Paper webs have for long been dried mainly by means of drying cylinders, a large number of which are fitted in succession in the dryer section in one or two, or even more, rows situated on top of one another.

When drying with drying cylinders, the drying energy is obtained from the hot steam by means of which the cylinders are heated. In the dryer section the cylinders are combined into cylinder groups, typically into groups of 3 to 8 cylinders. Pressurised, saturated steam is passed through the cylinders in each cylinder group at a pressure calculated in advance for the cylinder group in question. The exhaust steam that has flowed through each cylinder group and the condensate are passed to the condensate tank, from which the steam—now at a lower pressure—is passed to the next cylinder group. In this way, for example, live steam fed to the dry end of the dryer section at a pressure of 3 bars can be passed on through all cylinder groups in the dryer section, towards the wet end of the dryer section. In the first cylinder group of the dryer section the pressure is typically below atmospheric pressure. If necessary, that is, in order to obtain the desired pressure, live steam can be supplied to the various cylinder groups in addition to the exhaust steam.

Drying is controlled by regulating the pressure of the live steam supplied to the dryer section. Control may take place manually or automatically. The efficiency of the dryer groups is typically controlled on the basis of a recipe, such as cascade control, which is guided by the dry matter content of the web coming out of the dryer section. The recipes used are recorded set value recommendations which have been found to be advantageous from the point of view of the quality of each paper grade respectively. However, the operational point of the process varies during production, which means that the set values would have to be adjusted continuously. Generally, adjustments to set values required by changes in the drying process are not made until the measured quality values change to the extent that they go beyond the limits set for them.

Drying with drying cylinders in its present form functions relatively well—it has been possible to increase the speeds of paper machines and runnability has improved thanks to closed draws. The great length of the dryer section has, however, still presented a problem, as it incurs considerable construction costs. Neither has cylinder drying always been considered sufficiently effective. The aim has, therefore, been to find new and more efficient solutions for web drying.

For some time now, infrared heaters have been incorporated in the dryer section, the said heaters being, however, used mainly for controlling the cross direction profile of the web.

Air impingement drying, that is, evaporation drying carried out by blowing hot air or other suitable hot gas, such as superheated steam, towards the web, has proved to be an efficient drying method. Air impingement can, for example, be directed at the web as it travels, supported by the dryer wire, across the surface of a large vacuum roll, cylinder or other likewise linear surface, as disclosed for example in the Applicant's earlier Finnish patent applications FI 971713, FI 971714 and FI 971715. In air impingement, high-speed hot air jets or, for example, jets of superheated steam, are blown from a hood covering the said surface towards the web being dried, which travels on the said surface. Air impingement thus brings about a powerful evaporation drying effect. An efficient ventilation effect for blowing off the humidity that has evaporated from the web is also achieved by means of air impingement. The drying energy required for air impingement is obtained, for example, from natural gas or another suitable fuel which can be used for heating the impingement air. Air impingement also requires blowing energy, electricity, for circulating the air in the drying device, that is, for blowing the hot air towards the web and for removing humid air from the area surrounding the web.

By means of air impingement devices, it has been possible to improve the efficiency of drying taking place in the dryer section considerably. Due to more efficient drying, it has been possible to shorten the dryer section correspondingly. Moreover, by means of air impingement, the drying conditions can be changed much more rapidly than by means of drying cylinders.

However, the control of drying in the dryer section is not under the control of the process controller in a manner that would be desirable. The recipe-based set-value control of adjustments is not a sufficiently effective tool for controlling more efficient drying and for taking into account the drying requirements at different points of the dryer section. Neither do recipe-based adjustments take the cost factors relating to different forms of energy into account.

The aim of the present invention is, therefore, to achieve an improved method and apparatus for controlling the drying process in the dryer section of a paper machine.

The aim is more particularly to achieve an improved method and apparatus which allow better than before for the different drying requirements at different points of the dryer section and the cost factors relating to different forms of drying energy.

A further aim is to achieve a method and apparatus, which allow both for quality requirements and for cost factors in drying control in the different parts of the dryer section.

In order to achieve the above aims, the method and apparatus relating to the invention are characterised by what is specified in the characterising parts of the independent claims presented below.

Controlling the drying process taking place in the dryer section of the paper machine so as to be optimal from the point of view of quality and costs can, according to a typical method relating to the invention, be carried out as follows:

- a method known as such is first used to calculate the total power requirement of the dryer section, which in this application refers to the amount of energy transferred to the web in order to effect the evaporation desired. The total power requirement can be determined on the basis of the total evaporation requirement.
- Typically, total evaporation, that is, the amount of water to be evaporated, is calculated from the difference between initial moisture content and desired final moisture content, when the production rate is known.
- Total evaporation can also be calculated on the basis of the amount of water discharged with the exhaust air from the dryer section, that is, by measuring the flow and humidity of the exhaust air, when the flow and humidity of the supply air are known.

On the other hand, the value of total evaporation can also be calculated by using physical and mathematical models known as such, when the process parameters are known.

The dryer section is then divided according to the paper grade, into imaginary drying segments, which behave differently as to drying or evaporation, or some other quality criteria. In this specification, the division of the dryer section or the division of the drying process has been described by the term "segment". Alternatively, the terms "stage" or "phase" could also have been used.

The first segment typically covers that part of the dryer section in which the web is heated to a temperature advantageous for evaporation. In this first segment, little evaporation takes place, nor is a high evaporation efficiency required in this segment. The next, that is, the second segment typically covers that part of the dryer section in which the free water, that is, the readily evaporable water in the web, is evaporated from it. A high level of evaporation takes place in the second segment and thus also the requirement for evaporation efficiency is high. In addition to free water, there is water between the fibres and inside the fibres in the web, this water being more difficult to evaporate from the web. The third segment of the dryer section typically covers this part of the water which is difficult to evaporate and requires a higher amount of energy in relation to the amount of water than in the second segment. In the last segment of the dryer section, no significant amount of evaporation typically takes place. In this fourth segment, the aim is often only to adjust the cross-direction profile of the web in terms of drying or to regulate other properties of the paper, such as curl.

The division into drying segments can be decided, for example, on the basis of drying simulations known as such. By means of drying simulations, it is possible to determine approximately where the different types of evaporation zones are physically located and to divide the dryer section on the basis of this into drying segments.

The division into segments may also take place in such a way that an optimal evaporation distribution is first compiled in a manner known as such and limit values are calculated for the desired, typically at least two, controlled variables of the dryer section, after which the dryer section is divided on the basis of these limit values into segments, so that in two adjacent segments the limit value of at least one controlled variable is different. If necessary, the division into segments can be changed, for example, for the duration of start-up.

The optimal evaporation distribution required can be compiled, for example, on the basis of a recipe or by utilising a machine-direction quality model or quality profile, when the geometry of the dryer section, the process parameters required, such as machine speed, paper grade and total evaporation required, are known.

In a dryer section comprising at least one drying cylinder unit and at least one air impingement unit, the pressure of the steam supplied to the drying cylinders, which affects the temperature of the cylinder, and the temperature of the blowing air, the speed of the blowing air, the humidity of the blowing air and/or the distance of the blow box from the web are typically used as controlled variables. The upper limit value of the steam pressure is determined, for example, by the adhesion of the paper to the surface of the drying cylinder, and the upper limit value of the temperature of the blowing air by the desired brightness of the paper. In the actual running situation, the controlled variables are adjusted in each drying segment within the calculated limit values.

According to the invention, the dryer section is typically divided into at least three different imaginary drying segments. In at least one, typically in several, drying segments there are dryer units using at least two different forms of energy and/or at least two separately adjustable dryer units using the same form of energy. In one drying segment there may thus be, for example, conventional drying cylinders and one or more air impingement units, in which case both steam and, for example, natural gas and electricity are used in the segment to effect drying. In another drying segment there may be drying cylinders and an infrared dryer, in which case steam and electricity are used in that segment. On the other hand, a segment may also comprise drying cylinder groups only. According to the invention, this type of segment is controllable if at least two of its cylinders can be adjusted independent of each other, that is, if two of its cylinders are provided with separately adjustable steam feeds. In a dryer section provided with a twin-wire draw, the upper and lower cylinders, for example, can be adjusted separately. A segment in the dryer section may of course comprise, for example, only one air impingement cylinder unit. If so desired, individual dryer units can simply be shut off.

If so desired, a larger segment, for example, the second segment described above can further be divided into two or more smaller segments, if this is advantageous from the point of view of optimisation as described below.

Once the dryer section has been divided into the imaginary drying segments, the calculated total drying efficiency is divided by means of a method known as such between the above-mentioned drying segments, so that the proportion of the drying power allotted to each drying segment will guarantee a good drying result in terms of the quality of the web being dried. For different paper grades the division may take place as a recipe-based offline calculation according to tables, that is, according to previous runs which have been found good.

It has now also been found that the energy costs of the dryer section can be minimised by optimising the energy costs within each drying segment according to the form of energy. In other words, it has been found that the power used by each drying segment to obtain the desired evaporation can be controlled so that the energy cost incurred by each drying segment within the power adjustment range is as low as possible. The invention makes it possible to control the power range of the dryer units inside the dryer section of the paper machine, for example, the drying cylinders, the air impingement units and the infrared dryers, so that an optimal moisture content or drying power distribution is achieved from the point of view of both quality and total energy consumption. According to the invention, the fine adjustment of evaporation advantageous from the viewpoint of quality and cost is carried out within the segments.

The proportion of drying power allotted to a drying segment to be optimised is, according to the invention, converted into input power for the dryer units within the said segment by utilising a mathematical model of the dryer group and an optimisation programme known as such. By means of physical calculation models describing the operation of the dryer units, such as evaporation and heat transfer, and calculation models describing the cost of the energy forms of the dryer units, the energy costs within each segment can be optimised.

As regards the optimisation of energy costs, it is obviously possible to apply the invention to one entire dryer section and to calculate its optimal control in terms of quality and energy costs.

The measurement data required for the dryer group calculation model can be measured continuously by means of measuring sensors, or some of them may be selected empirically or be set as constants at start-up.

Control relating to the invention can be used for post-start-up control in a stable production situation. During change of grade, the set values of the dryer section are controlled by special control for grade change. The optimisation relating to the invention is preferably begun once the grade change has been made and the quality values for the grade in question are within acceptable limits. The principal aim of the invention is to bring about cost savings by running in a way, which is optimal as such in terms of quality.

It is possible for the operator of the dryer section to change the set values obtained by optimisation and to lock the values desired, whereby only the unlocked energy forms of each drying segment can be optimised as described above. The operator may also determine the drying distribution or the power range manually by forced control.

The principal advantage of the invention can be considered to be the fact that a method for controlling drying which takes into account both quality requirements and cost factors—particularly the cost of different forms of drying energy—has now been accomplished. The desired final moisture content and quality can be achieved in various ways, that is, the desired final moisture content can be obtained by controlling the power distributed to each drying segment in different ways. Different forms of energy have, however, different cost effects on the implementation of drying. According to the invention, the aim is to allot the drying power to the different dryer units of the drying segment in such a way that the total energy cost for drying is as low as possible. By means of the solution relating to the invention, the drying efficiency can be controlled in an optimal manner with a view to drying costs in all production situations, for all paper grades and at all production rates.

The drying control relating to the invention can be arranged to be automatically adjustable. By means of the calculation model, optimal control values can be set for the energy inputs of the drying segments automatically, which means that the process is under controlled drying in all running situations.

The control method relating to the invention also makes it possible for the entire drying process to be observed on the screen by the process controller better than before, and it is thus under good control.

Figure 2:
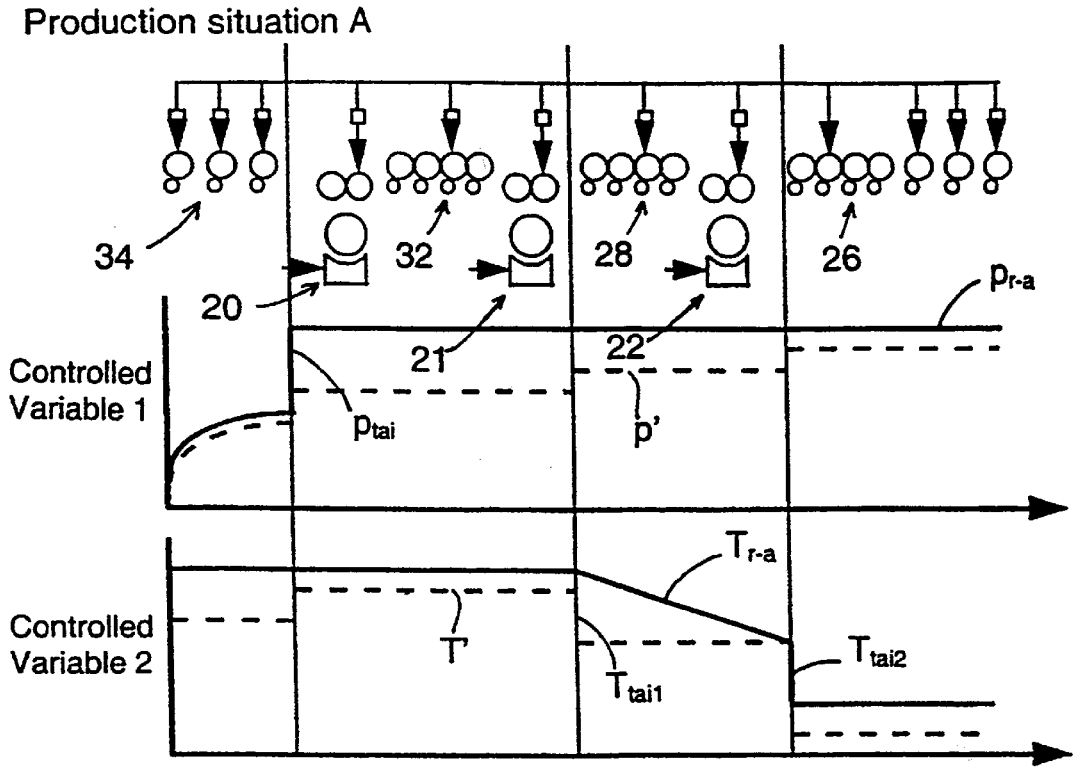
Figure 3:
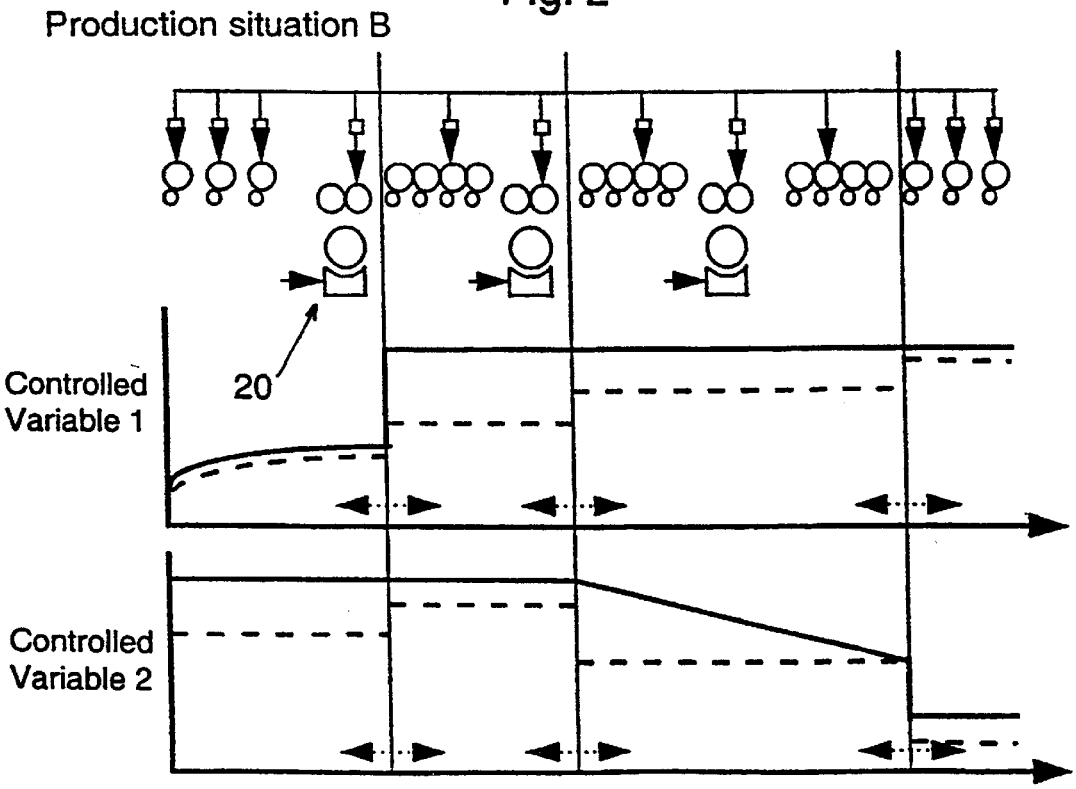

The invention is described in greater detail in the following, with reference to the appended drawings, in which FIG. 1 shows a diagrammatic cross-section of the dryer section of a paper machine and, in boxes, the typical stages of control according to the invention, and FIGS. 2 and 3 show diagrammatically the limit values of the controlled variables relating to the invention for the dryer section shown in FIG. 1 in two different production situations, and the division of segments in these situations.

The dryer section shown in FIG. 1 is divided, as proposed in the invention, into drying segments 10, 12, 14 and 16, in each of which there are drying cylinders 18 in different kinds of groups, that is, in different dryer units with cylinder groups comprising one, two or four cylinders. Moreover, the drying segments 10, 12 and 14 each have an air impingement unit 20, 21, 22. At the start of the dryer section a measuring device 23 is fitted for measuring the moisture content of the wet web. Correspondingly, at the end of the dryer section a measuring device 24 is fitted for measuring the moisture content of the dry web.

The figure further shows with arrows the drying energy flows coming to the different dryer units, that is, to cylinder groups and air impingement units. In the case shown in the figure, live steam, which is designated by the arrow 26', is supplied to the cylinder group 26 of the drying segment 14. From this cylinder group steam is passed to other cylinder groups in the dryer section, such as the groups 28, 30, 32 of segment 12, and group 34 of segment 10, as shown by the arrows 28', 30', 32', 34'. Correspondingly, gas and electricity are supplied to the air impingement units 20, 21, 23, as shown by the arrows 20', 20"; 21', 21"; 22', 22".

Live steam, the amount of which is controllable, can also be supplied directly to the segments.

Control relating to the invention is carried out in such a way that once the process has stabilised, e.g. after change of grade or other start-up, the total evaporation requirement is first measured or calculated by utilising the information obtained from the measuring devices 23, 24. At the first stage the total power requirement A is calculated from total evaporation. At the next stage, the total power requirement A is divided, by using quality criteria, physical and mathematical models, and an optimisation method known as such, between the drying segments 10, 12, 14, 16 as power inputs B10, B12, B14, B16.

After this, the drying power of each of the desired drying segments is distributed to the dryer units in the segments as input power. In this way, for example, in segment 12 in FIG. 1, the drying power B12 is divided according to the invention between the cylinder group units 28, 30, 32 and the air impingement unit 21, so that the overall costs within certain limit values are minimised.

In the control method relating to the invention for example, the mathematical models presented in the following publications can be used:

Wilhelmsson, B., Nilsson, L., Stenström, S. and Wimmerstedt, R., 1993, "Simulation Models of Multi-Cylinder Paper Drying", Drying Technology 11 (6) pp. 1177–1203.

Karlsson, M., Paltakari, J., Soininen, M. and Paulapuro, H., 1993, "A Simulation Model for Board and Paper Machine Dryer Section", pp. 9–16 in ASME HTD, Vol. 238.

Karlsson, M. A. and Timofeev, O. N., 1994, "The Computer Simulation of a Multicylinder Dryer with a Single-tier Configuration", Proc. Fifth International Symposium of Process Systems Engineering, Seoul, Korea.

Polat, O. and Mujumdar, A. S., 1987, "Drying of Pulp and Paper", pp. 643–682 in A. S. Mujumdar (ed.) Handbook of Industrial Drying, Marcel Dekker, New York.

Soininen, M., 1980, "A Mathematical Model of the Contact Drying Process", pp. 315–321 in A. S. Mujumdar (ed.) Drying "80, Vol. 2. Hemisphere Publ. Corp., Washington.

Soininen, M., 1991 "Modelling of Web Drying", Proc. The Helsinki Symposium of Alternate Methods of Pulp and Paper Drying, Helsinki, pp. 1–16.

Similarly, in the control method relating to the invention an optimisation method known as such, such as any of the optimisation methods presented in the following publications, can be used:

Rao, Singiresu S., "Optimization; Theory and Application", New Delhi, Wiley, cop. 1979.

Bertsimas, Dimitris, "Introduction to linear optimization", Belmont, Mass., Athena Scientific 1997.

FIG. 2 shows diagrammatically the drying cylinder groups 26, 28, 32, 34 and the air impingement units 20, 21, 22 of the dryer section relating to FIG. 1. FIG. 2 also shows the calculated limit values for two controlled variables, the steam pressure $p_{r\text{-}a}$ of the cylinders and the temperature $T_{r\text{-}a}$ of the blowing air. FIG. 2 shows that the limit value for the steam pressure first increases relatively slowly up to a certain portion of the dryer section, to the so-called point of change $P_{tai}$ of the steam pressure limit value, after which the pressure may remain almost constant. Similarly, the limit value of the temperature of the air impingement air first remains at a relatively high level and almost constant up to a certain portion of the dryer section, the point of change $T_{tai1}$ of the temperature, after which the temperature must fall in a certain portion of the dryer section to a certain lower value. The limit value for the temperature reaches another point of change $T_{tai2}$ of the temperature at the end of the dryer section. Lower limit values are preferably specified for the controlled variables in a corresponding manner.

According to the invention, the dryer section is divided at the above-mentioned points of change $p_{tai}$, $T_{tai1}$, $T_{tai2}$, of the limit values or in their vicinity, into different segments, in each of which it is possible to regulate energy consumption separately in the desired manner, in order to achieve desired optimal evaporation and total energy consumption. Within the segments, the controlled variables, for example, the steam pressure and air temperature can be adjusted within the limit values, for example, to the level indicated by the broken lines p' and T'.

FIG. 3 shows another running situation for the same dryer section, in which e.g. the limit value of steam pressure remains low over a longer portion of the dryer section than in the case of FIG. 2. In the case of FIG. 3, the point of change $p_{tai}$ of the steam temperature has moved beyond the first air impingement unit 20. As shown by the horizontal arrows in FIG. 3, the boundaries between the different segments can be changed, even during operation if necessary.

FIGS. 2 and 3 show the control of the drying process in the dryer section according to the invention, in which optimal evaporation is first compiled in a manner known as such, e.g. on the basis of a recipe or by utilising a machine-direction quality model or quality profile, when the geometry of the dryer section, the process parameters required, such as machine speed, paper grade and total evaporation required, are known, and after this limit values are calculated for at least two controlled variables of the dryer section, such as the steam pressure p and the temperature T of blowing air, making use of drying quality models known as such, such as models representing the adhesion and brightness of paper, after which the dryer section is divided on the basis of the distribution formed by the limit values of the controlled variables into drying segments so that in two adjacent segments the limit value of at least one controlled variable is different, and the drying process is controlled by adjusting the controlled variables in each drying segment, within the limit values of the controlled variables.

In this specification and in the claims presented below, 'dryer section' refers, unless otherwise specified, to all types of paper, board and tissue machine dryer sections, also to the pre- and post-drying sections of these machines, as well as to the dryer sections of separate coating machines.

The desired final moisture content and quality can be achieved by controlling the power of the dryer groups in different ways. Control can allow for the different effects of different forms of energy on energy costs. The aim may be to control the drying distribution so that the cost of the total energy used for drying will be as low as possible. According to the invention, optimal drying can be achieved at all operational points, with all grades and at all production rates. By means of the model, optimal set values of control for the drying power of energy inputs can be set automatically, which means that the process is under control in all running situations.

The aim is not to limit the invention only to the solutions described above in an exemplary manner, but rather to apply it widely within the scope of inventive idea specified in the claims below.

What is claimed is:

1. A method for controlling the drying process taking place in a dryer section of a paper machine comprising the steps of:

calculating a total amount of drying power required in the dryer section;

dividing the dryer section into at least a first drying segment, and a second drying segment, which differ in their drying action and apportioning the total amount of drying power between said first drying segment and said second drying segment so as to provide a drying distribution for providing a drying process maximizing quality, wherein at least said second drying segment includes two dryer units using different forms of energy; and wherein the proportion of the total amount of drying power apportioned to said second of said drying segments is divided according to said two different forms of energy between the at least two dryer units therein so that the sum of energy costs in said second drying segment is minimized.

2. The method of claim 1 wherein mathematical models based on the underlying physics of the dryer units are used to calculate the effects on a paper web of varying the energy input to the dryer units, the calculated effects being used to determine the minimum energy cost to achieve an allocated amount of drying in each dryer unit, and supplying energy to the dryer units in accord with the models.

3. The method of claim 1 wherein the total drying required in the dryer section is calculated by utilizing web moisture measurement before and after the drying process taking place in the dryer section.

4. The method of claim 1 wherein the total drying required in the dryer section is calculated on the basis of the total evaporation required, which total evaporation required is calculated by utilizing the amount of water discharged with exhaust air from the dryer section, the said amount of water being measured by measuring the flow and humidity of the exhaust air.

5. The method of claim 1 wherein the total drying required in the dryer section is calculated based on a moisture content of the web going in to the dryer section and a desired moisture content of the web after the dryer section.

6. The method of claim 1 wherein the dryer section is divided for purposes of calculation into the two or more successive drying segments by utilizing a model, said model being used to divide the dryer section into at least the first drying segment, and the second drying segment.

7. The method of claim 2 wherein the mathematical models are used to output values which can be programmed into a control system.

8. The method of claim 1 wherein the dryer section is divided into at least three drying segments to be optimized, and wherein the proportions of drying allocated to the at least three drying segments is converted into power inputs for each dryer unit, so that the sum of the energy costs of the at least three drying segments is minimized.

9. The method of claim 1 wherein the drying segment being optimized comprises at least one dryer unit using steam as the form of energy, and at least one dryer unit using hot gas as the form of energy.

10. The method of claim 1 wherein the drying segment being optimized comprises at least one dryer unit using steam as the form of energy, and at least one dryer unit using electricity as the form of energy.

11. The method of claim 1 wherein the drying segment being optimized comprises at least two drying cylinder groups provided with separate steam feeds.

12. The method of claim 1 wherein the method for controlling the drying process taking place in the dryer section is employed once the dryer section has reached selected conditions selected in terms of web quality after a change of grade or other corresponding change in the running status.

13. A method for controlling the drying process taking place in a dryer section of a paper machine comprising the steps of:

calculating a total amount of drying power required in the dryer section;

dividing the dryer section into at least a first drying segment, and a second drying segment which differ in their drying action, and apportioning the total amount of drying power between said first drying segment and said second drying segment so as to provide a drying distribution for providing a drying process maximizing quality, wherein at least said second drying segment includes at least two separately adjustable dryer units using the same form of energy; and wherein the proportion of the total amount of drying power apportioned to said second drying segment is of the same form of energy and is divided between the at least two dryer units therein so that the sum of energy costs in said second drying segment is minimized.

14. The method of claim 13 wherein mathematical models based on the underlying physics of the dryer units are used to calculate the effect on a paper web of varying the energy input to the dryer units, the calculated effect being used to determine the minimum energy cost to achieve an allocated amount of drying, and supplying energy to the drying units in accord with the mathematical models.

15. The method of claim 13 wherein the total amount of drying power required in the dryer section is calculated by utilizing web moisture measurement before and after the drying process taking place in the dryer section.

16. The method of claim 13 wherein the total amount of drying power required in the dryer section is calculated on the basis of the total evaporation required, which total evaporation required is calculated by utilizing the amount of water discharged with exhaust air from the dryer section, the said amount of water being measured by measuring the flow and humidity of the exhaust air.

17. The method of claim 13 wherein the total drying power required in the dryer section is calculated based on a moisture content of the web going in to the dryer section and a desired moisture content of the web after the dryer section.

18. The method of claim 13 wherein the dryer section is divided for purposes of calculation into two or more successive drying segments by utilizing a model, said model being used to divide the dryer section into at least the first drying segment, and the second drying segment.

19. The method of claim 14 wherein the mathematical models are used to output values which can be programmed into a control system.

20. The method of claim 13 wherein the dryer section is divided into at least three drying segments to be optimized, and that the proportions of drying allocated to the at least three drying segments is converted into power inputs for the dryer unit, so that the sum of the energy costs of the three drying segments is minimized.

21. The method of claim 13 wherein the drying segment being optimized comprises at least two drying cylinder groups provided with separate steam feeds.

22. The method of claim 13 wherein the method for controlling the drying process taking place in the dryer section is employed once the dryer section has reached selected conditions selected in terms of web quality after a change of grade or other corresponding change in the running status.

23. An apparatus for controlling a drying process taking place in a web in a dryer section of a paper machine, said apparatus comprising:

a calculation means for calculating a total drying required in the dryer section and for calculating a selected drying distribution, for providing a drying process maximizing quality;

the dryer section comprising at least two drying segments which differ in their drying action, at least one of which segments comprises at least two dryer units using different forms of energy;

a means for dividing the drying distribution allotted to a drying segment by said optimal drying distribution, between the at least two dryer units using different forms of energy therein, so that the sum of energy costs in said drying segment is minimized; and an apparatus for drying the wed in each drying segment by the drying distribution allotted to each segment, respectively.

24. The apparatus for controlling the drying process taking place in the dryer section of a paper machine of claim 23 wherein the apparatus is operated on the basis of mathematical models based on the underlying physics of the dryer units which are used to calculate the effects on the paper web of varying energy input to the dryer units, the calculated effects being used to determine the minimum energy cost to achieve the drying distribution, and supplying energy to the at least two drying units in accord with the models.

25. The apparatus for controlling the drying process taking place in the dryer section of a paper machine of claim 23 further comprising measuring sensors fitted in the dryer section for measuring measurement data required by the calculation means.

26. The apparatus for controlling the drying process taking place in the dryer section of a paper machine of claim 23 further comprising one or more process displays connected to the dryer section, on which the drying process can be monitored and controlled by bypassing the calculation means.

27. An apparatus for controlling a drying process taking place in a web in a dryer section of a paper machine, the apparatus comprising:

a calculation means for calculating the total drying required in the dryer section and for calculating the drying distribution, for providing a drying process maximizing quality;

the dryer section comprising at least two drying segments which differ in their drying action, at least one of which segments comprises at least two separately adjustable dryer units the same from of energy;

a means for dividing the proportion of drying allotted to a drying segment by said optimal drying distribution, between the at least two dryer units using different forms of energy therein, so that the sum of energy costs in said drying segment is minimized; and an apparatus for drying the web in each drying segment by the drying distribution allotted to each segment, respectively.

28. The apparatus for controlling the drying process taking place in the dryer section of a paper machine of claim 27, wherein the apparatus is operated on the basis of mathematical models based on the underlying physics of the dryer units which are used to calculate the effects on a paper web of varying energy input to the dryer units, the calculated effects being used to determine the minimum energy cost to achieve the drying distribution, and supplying energy to the at least two drying units in accord with the models.

29. The apparatus for controlling the drying process taking place in the dryer section of a paper machine of claim 27, further comprising measuring sensors fitted in the dryer section for measuring measurement data required by the calculation means.

30. The apparatus for controlling the drying process taking place in the dryer section of a paper machine of claim 27 further comprising one or more process displays, connected to the dryer section, on which the drying process can be monitored and controlled by bypassing the calculation means.

31. A method for controlling the drying process taking place in a dryer section of a paper machine comprising the steps of:

determining the total evaporation requirement for a paper web in a drying section;

determining from the total evaporation requirement for a paper web, a total amount of drying power to effect the total evaporation requirement;

partitioning the drying section for analysis purposes into at least two dryer segments selected from the group consisting of: a first segment where energy transferred to the web principally results in an increase in the web temperature, a second segment where energy transferred to the web causes free water associated with the web to evaporate, a third segment wherein energy transferred to the web causes water between the fibers and inside the fibers to evaporate, and a fourth segment where the properties of the web are adjusted with little evaporation;

apportioning the total amount of drying power between said at least two drying segments according to a recipe or according to a model;

wherein one of said at least two drying segments has at least two drying units using different forms of energy selected from the group consisting of: steam, electricity, and natural gas; and wherein the proportion of the total amount of drying power apportioned to said one of said at least two drying segments is divided according to said different forms of energy between the at least two dryer units so that the sum of energy costs in said one of said at least two drying segments is minimized.

32. A method for controlling the drying process taking place in a dryer section of a paper machine comprising the steps of:

determining that total evaporation requirement for a paper web in the dryer section;

determining from the total evaporation requirement for a paper web, a total amount of the web drying power to effect the total evaporation requirement;

partitioning the dryer section for analysis purposes into at least two drying segments selected from the group consisting of: a first segment where energy transferred to the web principally results in an increase in the web temperature, a second segment where energy transferred to the web causes free water associated with the web to evaporate, a third segment wherein energy transferred to the web causes water between the fibers and inside the fibers to evaporate, and a fourth segment where the properties of the web are adjusted with little evaporation;

apportioning the total amount of drying power between said at least two drying segments according to a recipe or according to a model;

wherein one of said at least two drying segments has at least two separately adjustable dryer units using the same form of energy selected from the group consisting of: stream, electricity, and natural gas; and wherein the proportion of the total amount of drying power apportioned to said one of said at least two drying segments is of said same form of energy and is divided between the at least two dryer units so that the sum of energy costs in said one of said at least two drying segments is minimized.

* * * * *

UNITED STATES PATENT AND TRADEMARK OFFICE

CERTIFICATE OF CORRECTION

PATENT NO. : 6,792,331 B1
DATED : September 14, 2004
INVENTOR(S) : Kristian Hamström et al.

It is certified that error appears in the above-identified patent and that said Letters Patent is hereby corrected as shown below:

Title page,
Item [57], ABSTRACT,
Lines 2-3, delete "or the like" after "machine".

Column 6,
Line 8, "23," should be -- 22, --.

Column 10, line 67 thru Column 11, line1,
"different forms" should be -- using the same form --.

Column 12,
Line 2, "drying" should be -- dryer --.
Line 19, delete "the web" before "drying power".

Signed and Sealed this

Fourteenth Day of December, 2004

JON W. DUDAS
*Director of the United States Patent and Trademark Office*